US007213805B2

(12) United States Patent
Nishimura et al.

(10) Patent No.: US 7,213,805 B2
(45) Date of Patent: May 8, 2007

(54) CLAMPING DEVICE

(75) Inventors: Eikichi Nishimura, Seki (JP); Takeshi Kunii, Gifu (JP)

(73) Assignee: Nishimura Press Kougyousho Co., Ltd., Seki-shi, Gifu (JP)

( * ) Notice: Subject to any disclaimer, the term of this patent is extended or adjusted under 35 U.S.C. 154(b) by 128 days.

(21) Appl. No.: 10/521,934

(22) PCT Filed: Jul. 25, 2003

(86) PCT No.: PCT/JP03/09464

§ 371 (c)(1),
(2), (4) Date: Jan. 24, 2005

(87) PCT Pub. No.: WO2004/018154

PCT Pub. Date: Mar. 4, 2004

(65) Prior Publication Data

US 2006/0049567 A1 Mar. 9, 2006

(30) Foreign Application Priority Data

Jul. 25, 2002 (JP) ..... 2002-217157

(51) Int. Cl.
*B25B 1/14* (2006.01)

(52) U.S. Cl. ..... 269/228

(58) Field of Classification Search ..... 269/228, 269/249, 91–94

See application file for complete search history.

(56) References Cited

U.S. PATENT DOCUMENTS 4,335,493 A * 6/1982 Shivers et al. ..... 29/254
5,924,685 A * 7/1999 Webb ..... 269/228

FOREIGN PATENT DOCUMENTS

| | | |
|---|---|---|
| JP | 50110191 | 8/1975 |
| JP | 63-136838 | 6/1988 |
| JP | 1-199744 | 8/1989 |
| JP | 2015238 U | 1/1990 |
| JP | 3086457 U | 9/1990 |
| JP | 5024423 Y | 6/1993 |
| JP | 9290338 | 11/1997 |

* cited by examiner

*Primary Examiner*—Robert C. Watson
(74) *Attorney, Agent, or Firm*—Carstens & Cahoon, LLP; Colin P. Cahoon; Christopher P. O'Hagan

(57) ABSTRACT

A clamping device includes a clamp arm attached to a mounting member to be able to reciprocate with respect to the mounting member, a pressure applying mechanism for applying pressure to the clamp arm, and a clamp bolt for clamping a member to be clamped between a support member and the clamp bolt. A threaded cylinder having an external thread portion on the outside and an internal thread portion on the inside is attached to the clamp arm such that the height of the threaded cylinder is adjustable by utilizing the external thread portion. The clamp bolt is screwed to the internal thread portion of the threaded cylinder. A manipulation portion is provided for rotating the clamp bolt in a state where the member to be clamped is clamped between the clamp bolt and the support member.

4 Claims, 7 Drawing Sheets

CLAMPING DEVICE

FIELD OF THE INVENTION

The present invention relates to a clamping device for clamping a workpiece at a predetermined position, which device is installed on a clamping jig for an assembly line or a welding operation of several types of products, or installed on the upper surface of a table supporting a workpiece for a machine tool.

BACKGROUND OF THE INVENTION

In the prior art, a toggle clamp disclosed in Japanese Laid-Open Utility Model Publication 63-136838 has been proposed. The toggle clamp of the above publication has a tightening force adjustment mechanism, which includes a base bracket, a workpiece pressing arm, and a handle. The workpiece pressing arm and the handle are designed to operate in cooperation via a toggle mechanism. The workpiece pressing arm is formed of a pair of strip-shaped arm plates to sandwich a vertical pin receiver of the base bracket. A slit is formed in each arm plate to extend in the longitudinal direction in parallel to the lower rim of the arm plate.

The slits receive the ends of a plate nut so that the plate nut slides freely. The plate nut includes rotation restricting steps, each of which is engaged with the rim of the corresponding slit. Furthermore, a U-shaped washer fitted to the lower rims of the arm plates has a central hole through which an adjustment bolt is inserted and screwed to the plate nut so that a lock nut on the adjustment bolt is tightened to the washer.

The tightening force adjustment mechanism of the toggle clamp adjusts the clamp position by moving the plate nut along the slits. However, since the adjustment bolt is fixed by the lock nut after adjusting the height of the adjustment bolt, the pressing force cannot be adjusted easily while clamping the workpiece.

That is, the height of the adjustment bolt needs to be adjusted by loosening the lock nut in a narrow space surrounded by the base bracket, the arm plates, and the workpiece. Thus, adjusting the pressing force applied to the workpiece is very troublesome.

Accordingly, it is an objective of the present invention to provide a clamping device that solves the problems of the prior art and finely and easily adjusts the pressing force while actually clamping a member that is to be clamped.

SUMMARY OF THE INVENTION

To solve the above problems, a clamping device of the present invention includes a support member for supporting a member to be clamped at a predetermined position, a mounting member attached to the support member, a clamp arm attached to the mounting member to be able to reciprocate with respect to the mounting member, a pressure applying mechanism, which is located between the mounting member and the clamp arm and applies pressure to the clamp arm, and a clamp bolt, which is located on the clamp arm and clamps the member to be clamped between the clamp bolt and the support member. Further, a threaded cylinder having an external thread portion on the outside and an internal thread portion on the inside is attached to the clamp arm such that the height of the threaded cylinder is adjustable by utilizing the external thread portion. The clamp bolt is screwed to the internal thread portion of the threaded cylinder. A manipulation portion is provided for rotating the clamp bolt in a state where the member to be clamped is clamped between the clamp bolt and the support member.

Therefore, the pressure applied to the member to be clamped is appropriately adjusted by the manipulation portion while the member to be clamped is actually clamped.

According to a clamping device of a modified embodiment of the present invention, the crank bolt is provided on the crank arm such that the position of the crank bolt is adjustable along the crank arm. A manipulation portion is provided on the clamp bolt above the clamp arm. The manipulation portion is used for rotating the clamp bolt in a state where the member to be clamped is clamped between the clamp bolt and the support member. Therefore, the pressure applied to the member to be clamped is easily adjusted by the clamp bolt by utilizing a wide space above the clamp bolt.

DETAILED DESCRIPTION OF THE PREFERRED EMBODIMENTS

A toggle clamp according to one embodiment of the present invention will now be described with reference to FIGS. 1 to 3.

Figure 1:
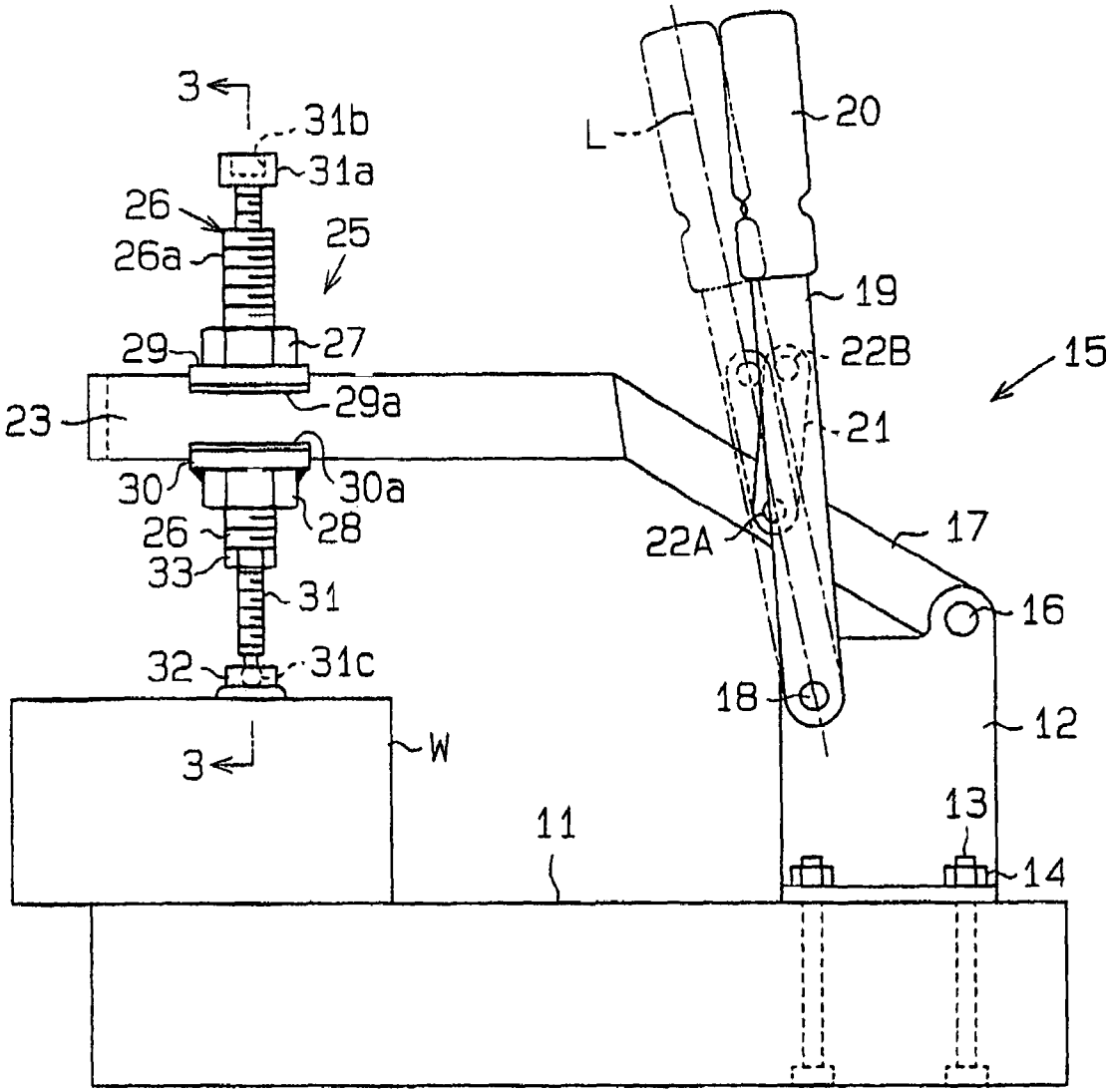
FIG. 1 is a front view illustrating a toggle clamp of the present invention clamping a workpiece.

As shown in FIG. 1, a pair of left and right mounting members, which are fixed mounting plates 12 in this embodiment, are arranged on an upper surface of a support member, which is a base bracket 11 in this embodiment. The mounting plates 12 are fixed to a predetermined position with four bolts 13, which are inserted through the base bracket 11 from below and upward, and nuts 14 screwed to the bolts 13. A pressure applying mechanism, which is a toggle mechanism 15 in this embodiment, is attached to upper ends of the mounting plates 12.

A clamp arm 17 extends substantially horizontally. The proximal end of the clamp arm 17 is rotatably coupled between the upper ends of the mounting plates 12 with a coupling pin 16. Therefore, the distal end of the clamp arm 17 can rotate back and forth in the vertical direction. A pair of manipulation levers 19 extends in a substantially vertical direction. The lower ends of the manipulation levers 19 are coupled to the outer surfaces of the upper end of the mounting plates 12 with a coupling pin 18 so that the manipulation levers 19 rotate forward and rearward and the direction of rotation alternates. A resin grip 20 is formed at the upper ends of the pair of manipulation levers 19 through insert molding. A toggle link 21 is located between the intermediate portion of the clamp arm 17 and the intermediate portion of each manipulation lever 19. Each toggle link 21 is coupled to the clamp arm 17 and the corresponding manipulation lever 19 with coupling pins 22A and 22B.

Figure 2:
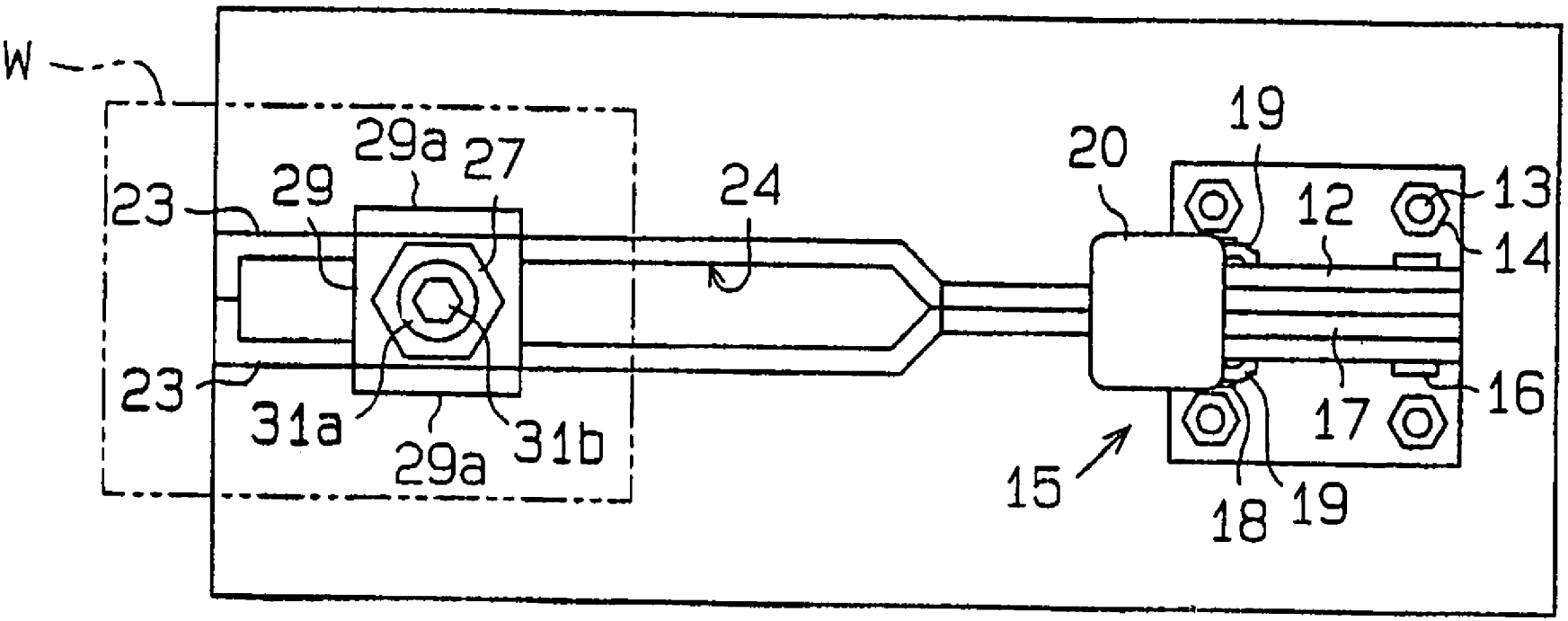
FIG. 2 is a plan view illustrating the toggle clamp of FIG. 1.
Figure 3:
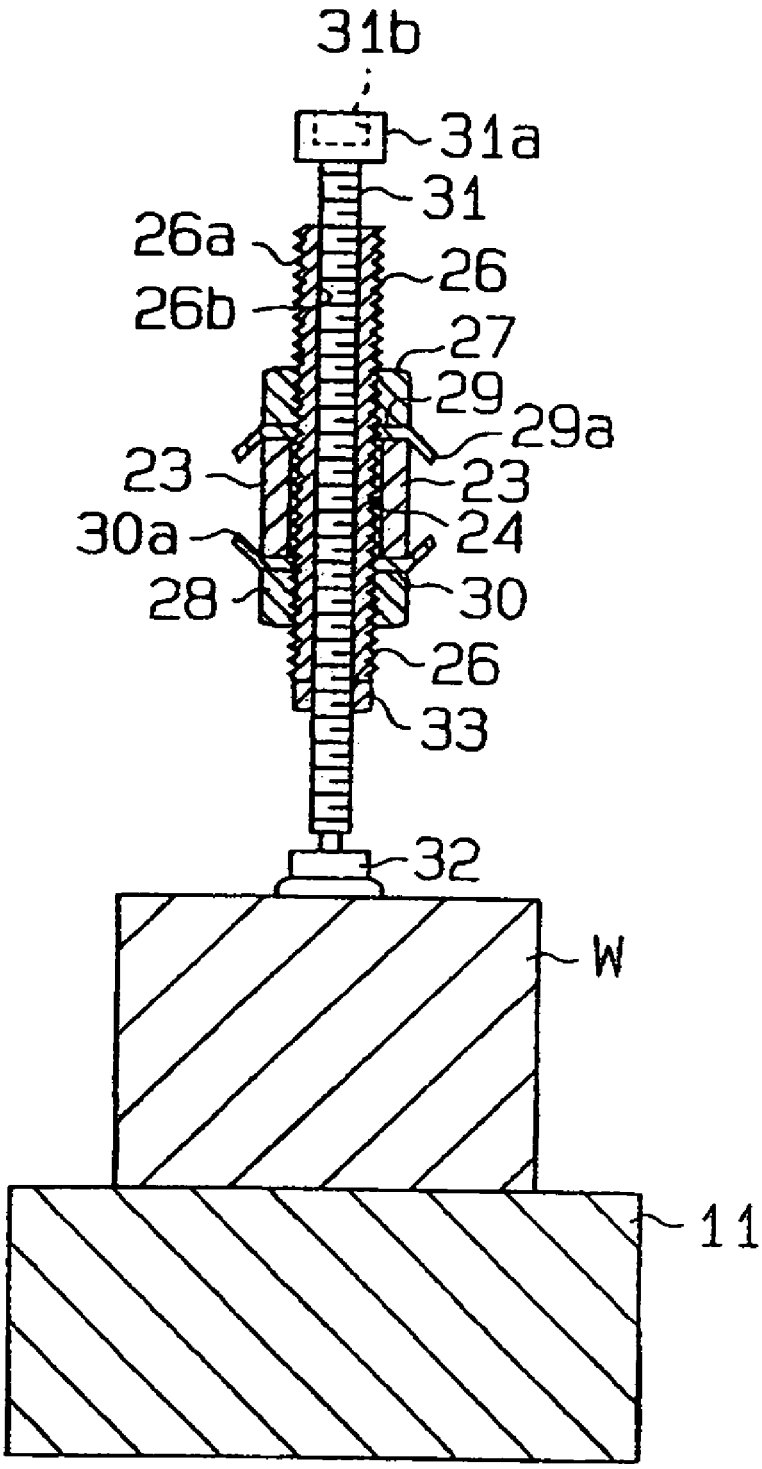
FIG. 3 is an enlarged cross-sectional view taken along line 3—3 of FIG. 1.

The clamp arm 17 is branched into a pair of left and right arm pieces 23 as shown in FIG. 2. A guide groove 24 is formed between the arm pieces 23 and perforates the arm pieces 23 in the vertical direction. A clamp bolt unit 25 is attached to the clamp arm 17 using the arm pieces 23 and the guide groove 24. The clamp bolt unit 25 includes a threaded cylinder 26, which is vertically inserted through the guide groove 24. A first lock nut 27 and a second lock nut 28 are screwed to an external thread portion 26*a* formed on the outer circumferential surface of the threaded cylinder 26.

An upper washer 29 is located between the upper surfaces of the arm pieces 23 and the lower surface of the first lock nut 27. A lower washer 30 is located between the lower surfaces of the arm pieces 23 and the upper surface of the second lock nut 28. The lower washer 30 and the second lock nut 28 are fixed by welding. As shown in FIG. 3, the left and right sides of each of the upper washer 29 and the lower washer 30 are bent to form a rotation restricting rib 29*a* or 30*a* to restrict rotation of the upper washer 29 or the lower washer 30 by engaging with the upper rim or lower rim of the arm pieces 23.

An internal thread portion 26*b* is formed vertically through the center of the threaded cylinder 26. A clamp bolt 31 is screwed to the internal thread portion 26*b* so that the vertical position of the clamp bolt 31 is adjustable. A head portion 31*a* is formed at the upper end of the clamp bolt 31. A hexagonal manipulation portion, which is an engaging hole 31*b* in this embodiment, is formed in the upper surface of the head portion 31*a* to be engaged with the distal end of a hexagonal wrench. A spherical portion 31*c* is formed at the lower end of the clamp bolt 31 and is engaged with a pad 32. The spherical portion 31*c* and the pad 32 are rotatable relative to each other. A third lock nut 33 is screwed to the outer circumference of the clamp bolt 31. The third lock nut 33 is securely tightened to the lower surface of the threaded cylinder 26 after the height of the clamp bolt 31 is adjusted so that the clamp bolt 31 is secured to the threaded cylinder 26.

In this embodiment, the guide groove 24 of the clamp arm 17, the first lock nut 27, the second lock nut 28, the upper washer 29, and the lower washer 30 constitute position adjusting means, which adjusts the clamp position of the threaded cylinder 26 and the clamp bolt 31.

Operation of the toggle clamp having the above structure will now be described.

As shown by a solid line in FIG. 1, when the manipulation levers 19 of the toggle mechanism 15 are rotated clockwise about the coupling pin 18, the toggle mechanism 15 is maintained inoperative. In this state, a workpiece W is placed at a predetermined position on the upper surface of the base bracket 11.

The clamp position is adjusted by moving the clamp bolt unit 25 horizontally along the guide groove 24 to match the position of the workpiece W with the first lock nut 27 loosened. After that, the first lock nut 27 is rotated in the tightening direction to secure the threaded cylinder 26 at the predetermined position of the clamp arm 17.

In this state, the height of the clamp bolt 31 is roughly adjusted by rotating the threaded cylinder 26 so that the pad 32 at the lower end of the clamp bolt 31 contacts the upper surface of the workpiece W. In this state, the manipulation levers 19 of the toggle mechanism 15 are rotated counterclockwise about the coupling pin 18 to press the clamp bolt 31 and the pad 32 against the upper surface of the workpiece W. Accordingly, the coupling pin 22A is located slightly on the right side of a dead line L, which connects the center of the coupling pin 18 and the center of the coupling pin 22B. Therefore, the workpiece W is clamped by a predetermined pressure. However, it is often the case that a desired pressure is not obtained by only rotating the toggle mechanism 15. Therefore, while the workpiece W is actually clamped, the distal end of the hexagonal wrench is engaged with the engaging hole 31*b* in the head portion 31*a* of the clamp bolt 31. When the hexagonal wrench is rotated, the clamp bolt 31 is rotated and the pressure is adjusted to an appropriate level.

The preferred embodiment has the following advantages.

(1) In the preferred embodiment, the threaded cylinder 26 is attached to the arm pieces 23 formed at the distal end of the clamp arm 17 so that the threaded cylinder 26 is horizontally adjustable along the guide groove 24. The clamp bolt 31 is screwed to the internal thread portion 26*b* formed at the center of the threaded cylinder 26 so that the clamp bolt 31 is vertically adjustable. Therefore, by engaging the hexagonal wrench with the engaging hole 31*b* in the head portion 31*a* of the clamp bolt 31 and rotating the hexagonal wrench while the workpiece W is clamped by the toggle mechanism 15 between the base bracket 11 and the pad 32, an operator is allowed to clamp the workpiece W with an appropriate pressure while perceiving the actual pressure with a hand. If a torque wrench is used instead of a normal hexagonal wrench to rotate the clamp bolt 31, the pressure is more accurately detected by a numerical value.

(2) In the preferred embodiment, the first lock nut 27 and the second lock nut 28 are screwed to the threaded cylinder 26, which is then moved in the guide groove 24. After that, the first lock nut 27 is tightened to secure the threaded cylinder 26. Therefore, the clamp position of the threaded cylinder 26 is easily adjusted with a simple structure.

(3) In the preferred embodiment, the pad 32 is provided at the outer end of the clamp bolt 31 via the spherical portion 31*c*. Therefore, when the clamp bolt 31 is rotated, the pad 32 does not rotate on the upper surface of the workpiece W. This prevents the upper surface of the workpiece W from being damaged.

(4) In the preferred embodiment, the second lock nut 28 is secured to the lower surface of the lower washer 30 by welding, and the rotation restricting rib 30*a* of the lower washer 30 is engaged with the lower rims of the arm pieces 23. Therefore, it is unnecessary to prevent rotation of the second lock nut 28 with, for example, fingers while rotating the threaded cylinder 26. This facilitates adjusting the height of the threaded cylinder 26.

(5) In the preferred embodiment, since the toggle mechanism 15 is used as the pressure applying mechanism, the pressure is easily applied to the workpiece W.

The preferred embodiment may be modified as follows.

Figure 4:
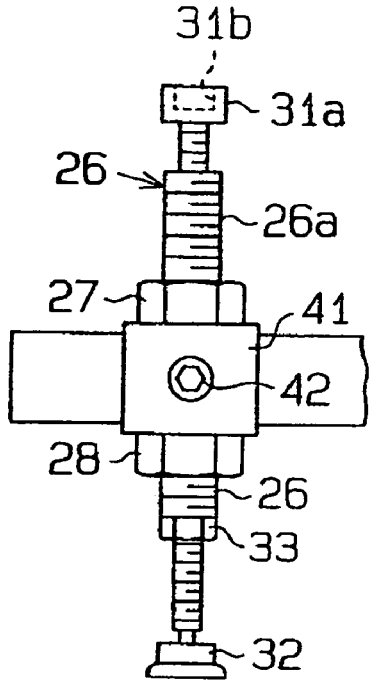
FIG. 4 is a front view illustrating a toggle clamp according to a modified embodiment of the present invention.
Figure 5:
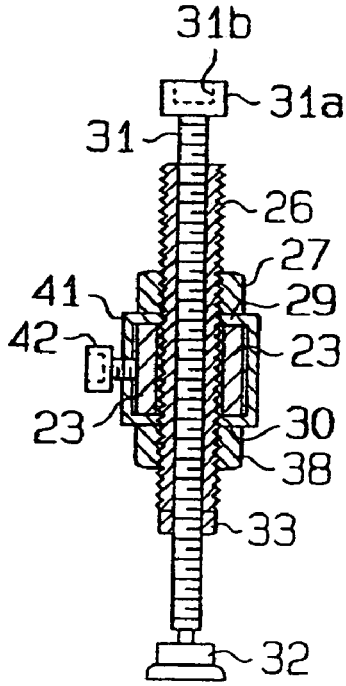
FIG. 5 is a longitudinal cross-sectional view illustrating the toggle clamp of FIG. 4.

In a modified embodiment shown in FIGS. 4 and 5, a tubular body 41 having a rectangular cross-section is fitted to the outer circumference of the arm pieces 23 to be slidable in the lateral direction. A bolt 42 is screwed to an internal thread portion formed in a side plate of the tubular body 41. The distal end of the bolt 42 is pressed against the side surface of one of the arm pieces 23 so that the tubular body 41 is secured to the side surface of the arm piece 23. The upper and lower plates of the tubular body 41 function as the upper and lower washers 29, 30. Other structures are the same as the preferred embodiment.

In this modified embodiment, the clamp position of the threaded cylinder 26 and the clamp bolt 31 is adjusted by reciprocating the tubular body 41 along the arm pieces 23 with the bolt 42 loosened. Then, the height of the threaded cylinder 26 is adjusted by loosening the first lock nut 27. Therefore, the height of the threaded cylinder 26 is adjusted in a stable manner. Other operations are the same as the preferred embodiment.

Figure 6:
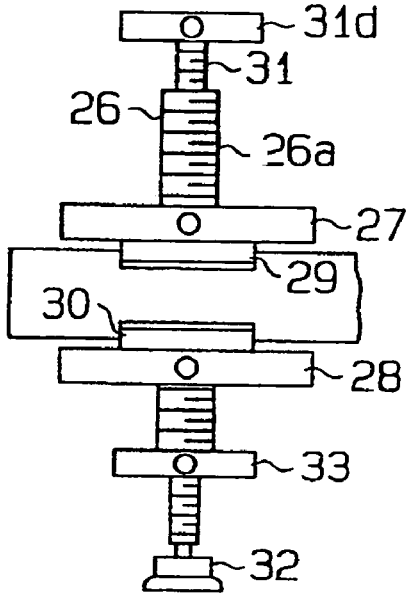
FIG. 6 is a front view illustrating a substantial part of the toggle clamp according to a modified embodiment of the present invention.
Figure 7:
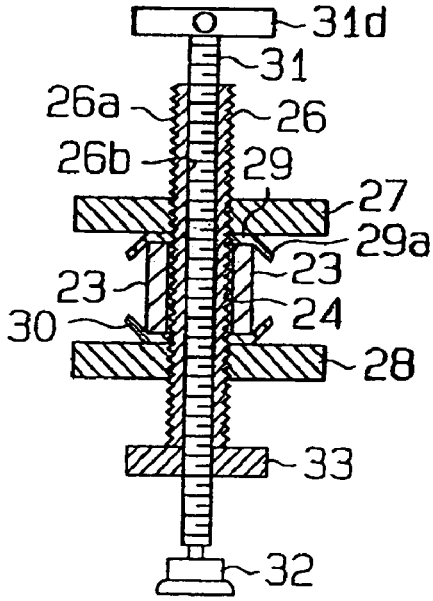
FIG. 7 is a longitudinal cross-sectional view illustrating the toggle clamp of FIG. 6.

In a modified embodiment shown in FIGS. 6 and 7, the shape of the two lock nuts 27, 28 of the preferred embodiment shown in FIGS. 1 to 4 is changed to a disk-like form, and the diameter is increased as compared to that of the lock nuts of the preferred embodiment of FIG. 1. A knurl is formed on the outer circumferential surface of each lock nut to prevent slipping. Also, a manipulation knob 31*d* for rotational manipulation is integrally or separately formed on the upper end of the clamp bolt 31. Furthermore, the third lock nut 33 is also formed as a large diameter disk and a knurl is formed on its outer circumferential surface to enable manipulation of the third lock nut. The second lock nut 28 and the lower washer 30 are formed separately.

In this modified embodiment, the first lock nut 27, the second lock nut 28, the clamp bolt 31, and the third lock nut 33 are easily rotated.

Figure 8:
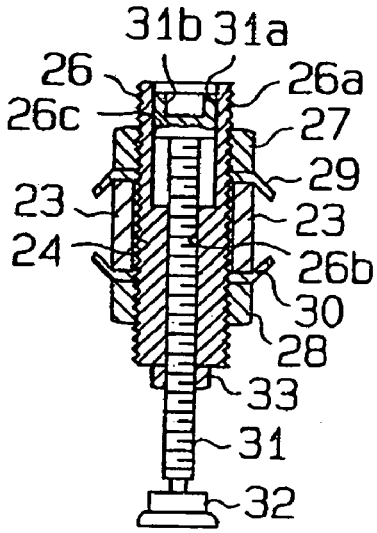
FIG. 8 is a longitudinal cross-sectional view illustrating a substantial part of the toggle clamp according to a modified embodiment of the present invention.

In a modified embodiment shown in FIG. 8, the internal thread portion 26*b* is formed at the lower section of the threaded cylinder 26 and a cylindrical accommodating bore 26*c* is formed at the upper section of the threaded cylinder 26. The head portion 31*a* formed at the upper portion of the clamp bolt 31 is accommodated in the accommodating bore 26*c*. In this modified embodiment, since the head portion 31*a* is not exposed outside the threaded cylinder 26, the appearance is simplified.

Figure 9:
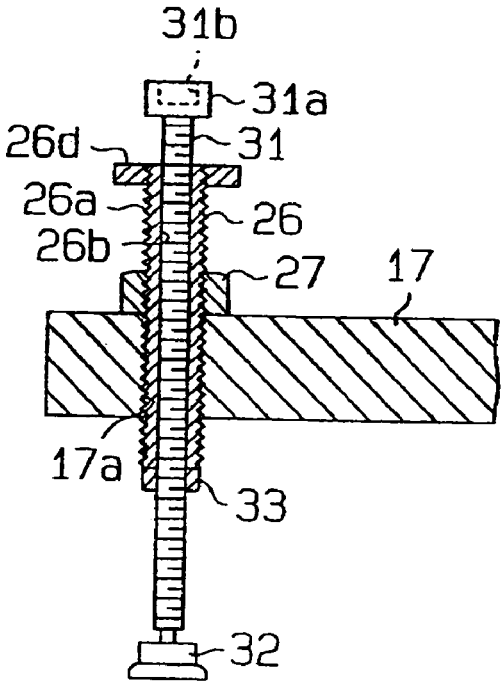
FIG. 9 is a longitudinal cross-sectional view illustrating a substantial part of the toggle clamp according to a modified embodiment of the present invention.

In a modified embodiment shown in FIG. 9, the threaded cylinder 26 is screwed to an internal thread portion 17*a* formed at the distal end of the clamp arm 17. The first lock nut 27 is screwed to the external thread portion 26*a* of the threaded cylinder 26. A manipulation piece 26*d* is screwed to the upper end of the threaded cylinder 26 and is secured to the threaded cylinder 26 by welding. The threaded cylinder 26 and the manipulation piece 26*d* may be integrally formed with each other.

In this modified embodiment, the clamping force is roughly adjusted by adjusting the height of the threaded cylinder 26 by rotating the manipulation piece 26*d* formed at the upper end of the threaded cylinder 26 with the first lock nut 27 loosened. The clamping force is then finely adjusted by rotating the clamp bolt 31 via the engaging hole 31*b* formed at the upper end of the clamp bolt 31 while the workpiece W is clamped.

In the preferred embodiment shown in FIG. 1 or the modified embodiments shown in FIGS. 4 and 6, a rotational manipulation knob (not shown) may be formed at the upper end of the threaded cylinder 26. In this case, the height of the threaded cylinder 26 is easily adjusted.

Figure 10:
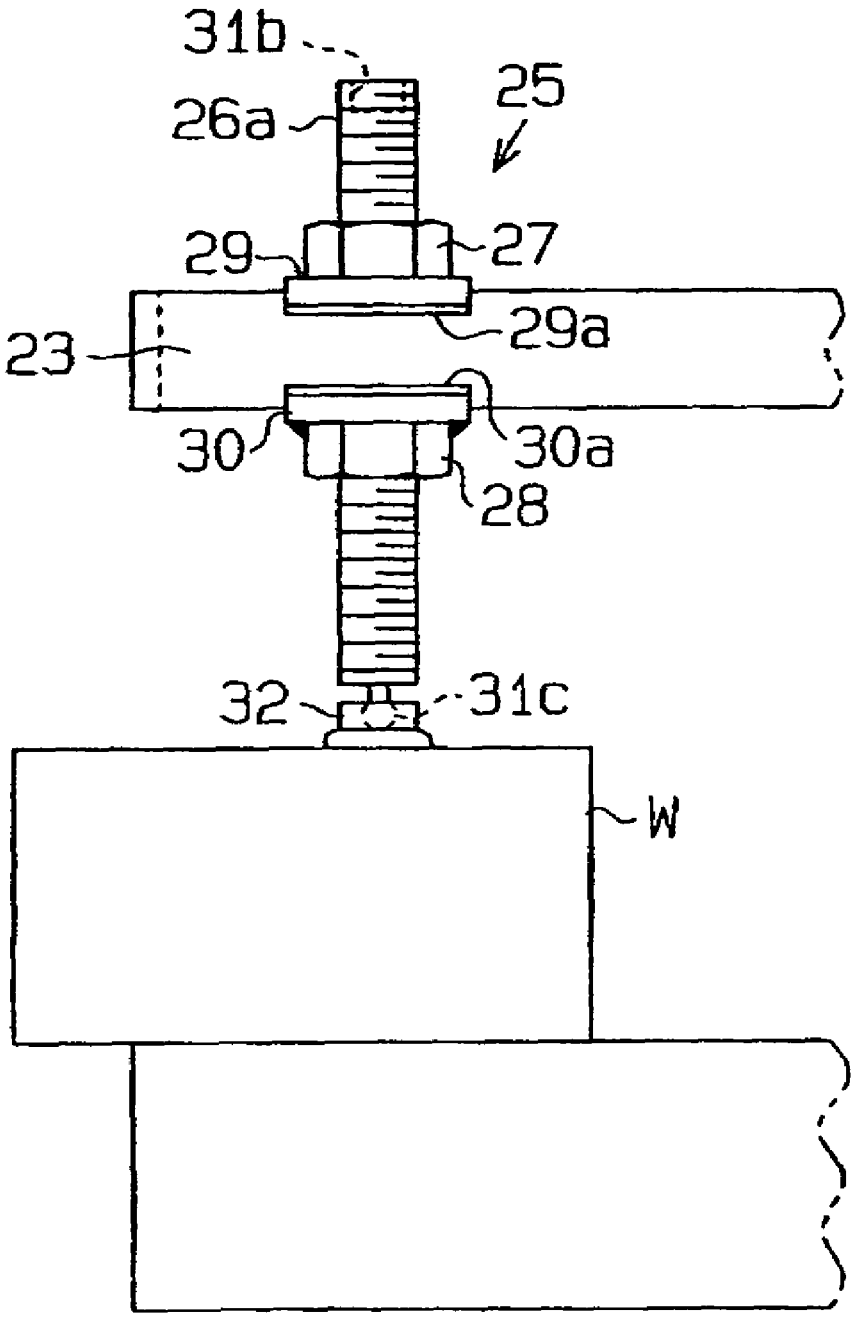
FIG. 10 is a longitudinal cross-sectional view illustrating a substantial part of the toggle clamp according to another modified embodiment of the present invention.

A modified embodiment shown in FIG. 10 differs from the preferred embodiment of FIG. 1 in that a solid clamp bolt 26*a* is provided instead of a combination of the hollow threaded cylinder 26 and the small diameter clamp bolt 31. The pad 32 that is the same as the preferred embodiment is attached to the lower end of the clamp bolt 26*a* via the spherical portion 31*c*.

Also, the upper end of the clamp bolt 26*a* is located above the arm pieces 23. The hexagonal engaging hole 31*b* for being engaged with the distal end of the hexagonal wrench is formed in the upper end face of the clamp bolt 26. The engaging hole 31*b* functions as a manipulation portion.

Therefore, in this modified embodiment, while the workpiece W is clamped by the toggle mechanism 15 between the base bracket 11 and the pad 32, the hexagonal wrench is engaged with the engaging hole 31*b* of the clamp bolt 26*a* and rotated. Thus, the workpiece W is clamped with an appropriate pressure while finely and easily adjusting the pressure of the clamp bolt 26*a*. Since a wide space above the clamp bolt 26*a* is used when adjusting the pressure, the operation is easily performed.

In addition to the above advantages, advantages are provided that are the same as the preferred embodiment of FIG. 1. Furthermore, the number of parts can be reduced to simplify the structure.

In the preferred embodiment, the second lock nut 28 and the lower washer 30 are coupled to each other. However, the second lock nut 28 and the lower washer 30 may be separated from each other.

Besides a workpiece that is processed by a machine tool, for example, a height detector may be a member to be clamped.

The pressure applying mechanism need not be formed by the toggle mechanism, but may be formed by a cam mechanism.

Instead of the base bracket 11, a support table for a workpiece for a machine tool may be used as the support member.

The clamping device may be used as a clamping jig for an assembly line or a welding operation of several types of products.

The invention claimed is:

1. A clamping apparatus for use in clamping a member, the clamping apparatus comprising a support member for supporting the member to be clamped at a predetermined position, a mounting member attached to the support member, a clamp arm attached to the mounting member to be able to reciprocate with respect to the mounting member, a pressure applying mechanism, which is located between the mounting member and the clamp arm and applies pressure to the clamp arm, and a clamp bolt, which is located on the clamp arm and clamps the member to be clamped between the clamp bolt and the support member, wherein a threaded cylinder having an external thread portion and an internal thread portion is attached to the clamp arm, wherein the height of the threaded cylinder is adjustable by utilizing the external thread portion and wherein the clamp bolt is screwed into the internal thread portion of the threaded cylinder;

wherein a groove is formed in the clamp arm, the threaded cylinder containing the clamp bolt is attached to the guide groove such that the position of the threaded cylinder is adjustable, wherein when the threaded cylinder is inserted in the guide groove, a first lock nut and a second lock nut are screwed to the external thread portion of the threaded cylinder to sandwich the clamp arm from above and below, and the threaded cylinder is secured at a predetermined position of the clamp arm by securely tightening the first lock nut and the second lock nut to the clamp arm, wherein an upper washer is located between the clamp arm and the first lock nut and a lower washer is located between the clamp arm and the second lock nut, the upper washer and the lower washer each have a rotation restricting rib, the rotation restricting ribs are engaged with the upper and lower rims of the clamp arm for restricting rotation of the upper washer and the lower washer, wherein the second lock nut is fixed to the lower surface of the lower washer, and wherein a manipulation portion is provided on the clamp bolt above the clamp arm, the manipulation portion being used for rotating the clamp bolt within the threaded cylinder in a state where the member to be clamped is clamped between the clamp bolt and the support member.

2. The clamping apparatus according to claim 1, wherein an engaging hole is formed at an upper end of the clamp bolt, the engaging hole being engageable with the distal end of a wrench for rotational manipulation.

3. The clamping apparatus according to claim 1, wherein the pressure applying mechanism is a toggle mechanism.

4. The clamping apparatus according to claim 1, wherein a pad is located at the distal end of the clamp bolt, the pad abuts against an upper surface of the member to be clamped and permits the clamp bolt to rotate relative to the pad.

* * * * *